US005316307A

United States Patent [19]

Kersh

[11] Patent Number: 5,316,307

[45] Date of Patent: May 31, 1994

[54] THREE-DIMENSIONAL STRATEGY GAME

[76] Inventor: Karol W. Kersh, 285 Boice St. S., Salem, Oreg. 97302

[21] Appl. No.: 23,269

[22] Filed: Feb. 25, 1993

[51] Int. Cl.[5] ..... A63F 3/00

[52] U.S. Cl. ..... 273/241; 273/271; D21/23

[58] Field of Search ..... 273/241, 271; D21/23

[56] References Cited

U.S. PATENT DOCUMENTS

| | | | |
|---|---|---|---|
| 3,464,701 | 9/1969 | Mahoney | 273/241 |
| 3,884,474 | 5/1975 | Harper | 273/241 |
| 4,184,685 | 1/1980 | Wilson | 273/241 |
| 4,204,685 | 5/1980 | Jones | 273/241 |
| 4,883,278 | 11/1989 | Scott | 273/241 |
| 5,085,440 | 2/1992 | Van Daur | 273/241 |

FOREIGN PATENT DOCUMENTS

| | | | |
|---|---|---|---|
| 2550336 | 5/1977 | Fed. Rep. of Germany | 273/241 |
| 1283840 | 8/1972 | United Kingdom | 273/241 |

OTHER PUBLICATIONS

The Way to Play by the Diagram Group, Paddington Press Ltd. pp. 28-29, 1975.

Spencer Gifts Catalog "Now! Play Chess In 3-D", Sep. 9, 1970.

*Primary Examiner*—Benjamin H. Layno

*Attorney, Agent, or Firm*—Olson & Olson

[57] ABSTRACT

A three-dimensional strategy game is formed of four circular discs supported in vertically spaced apart relationship by peripherally spaced vertical posts. Each disc is provided with four concentric bands, and a plurality of station detents are located in each band on radial lines disposed 90° apart. The detents are configured to seat game piece balls, and the posts are formed of hollow tubes configured to receive the balls for storage. A side opening at the bottom of each tube allows removal of the bottommost ball for play. The method of play is to place game piece balls in detents on one or more of the four discs to form a sequence of straight lines, circles or spirals, with the player producing or discovering a sequence being the winner of the game.

6 Claims, 3 Drawing Sheets

THREE-DIMENSIONAL STRATEGY GAME

BACKGROUND OF THE INVENTION

This invention relates to strategy games, and more particularly to a three-dimensional game which enables a plurality of players to devise strategies to arrange a plurality of game pieces in any one of a variety of sequence patterns on one or more levels of the game.

Three-dimensional games have been provided heretofore. Typical of these are the games disclosed in U.S. Pat. Nos. 4,883,278; 4,204,685; 4,184,685; 3,884,474; and 3,464,701. None of these patents provides the structural arrangement by which this invention affords the variety of sequence patterns by which the game is successfully played.

SUMMARY OF THE INVENTION

The game of this invention includes a plurality of playing surfaces spaced apart vertically and each having a plurality of concentric bands and a plurality of game piece stations in the bands arranged on radial lines spaced apart about the periphery of the playing surfaces, for positioning game pieces during playing of the game.

The principal objective of this invention is the provision of a three-dimensional game of the class described which affords the strategic deployment of a plurality of playing pieces in a variety of sequences involving one or all of the playing levels.

Another objective of this invention is to provide a three-dimensional game of the class described in which the variety of sequences includes arrangements of playing pieces along straight radial lines, circles and spirals utilizing one or all levels, vertical lines utilizing all levels, and others.

A further objective of this invention is the provision of a three dimensional game of the class described in which the support structure for the vertically spaced playing surfaces also provides storage for the game pieces.

A still further objective of this invention is to provide a three-dimensional game of the class described which is of simplified construction for economical manufacture.

The foregoing and other objects and advantages of this invention will appear from the following detailed description, taken in connection with the accompanying drawings of a preferred embodiment.

DESCRIPTION OF THE PREFERRED EMBODIMENT

Figure 1:
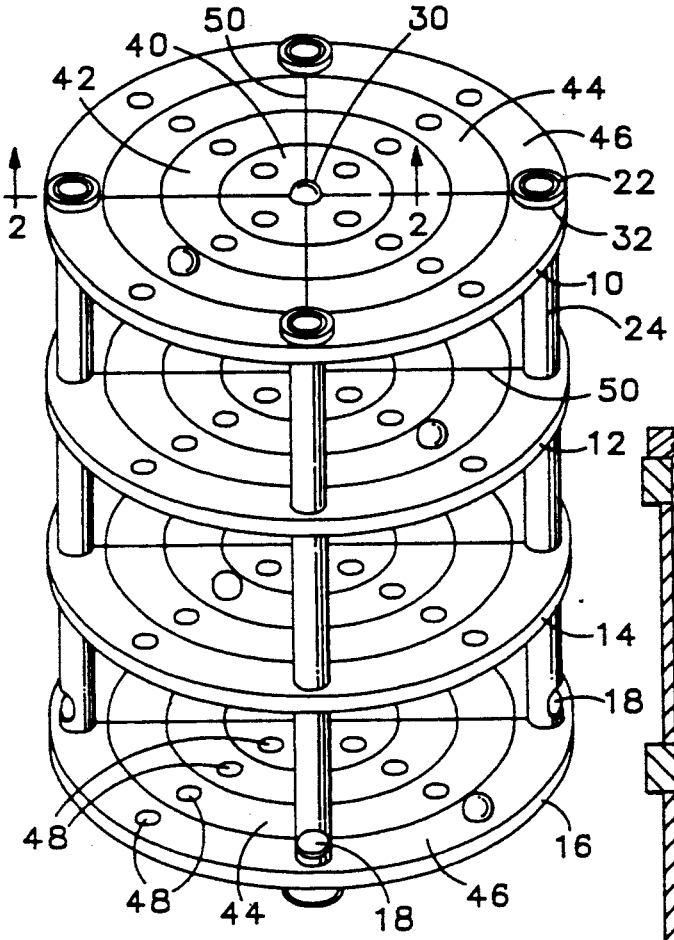
FIG. 1 is a perspective view of a three-dimensional strategy game embodying the features of this invention.
Figure 2:
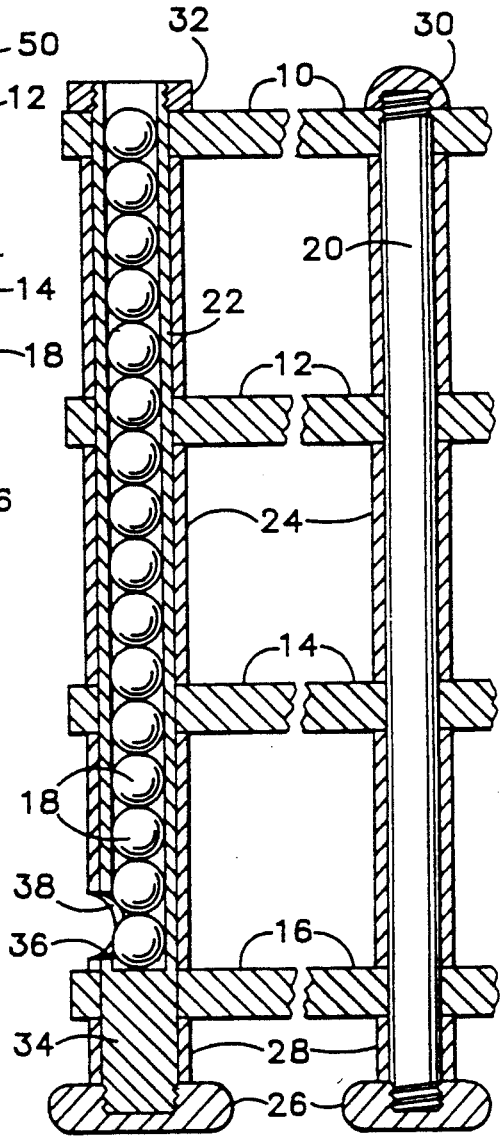
FIG. 2 is a fragmentary sectional view, on an enlarged scale, taken on the line 2—2 in FIG. 1.

Referring to FIGS. 1 and 2 of the drawings, the game illustrated includes a plurality of plates in the form of circular discs 10, 12, 14 and 16 which serve as playing surfaces upon which game pieces 18 are placed in sequential positions calculated to win the game.

The discs are supported in vertically spaced apart arrangement by a central vertical post 20 a plurality of peripherally spaced vertical posts 22 and a plurality of spacer sleeves 24. In the illustrated embodiment, the posts extend through aligned openings in the discs and the sleeves encircle the posts between the discs to space the discs apart.

The bottom ends of the posts are threaded for removable attachment of foot members 26. Short sleeves 28 are interposed between the foot members and the underside of the bottom disc. The upper ends of the posts also are threaded for removable attachment of center cap nut 30 and peripheral clamp nuts 32.

The central post 20 is shown to be a solid rod and the peripheral posts 22 are hollow tubes. The lower ends of the tubes are closed by plugs 34 which extend to the upper surface of the bottom disc 16. The upper ends of the tubes 22 and the clamp nuts 32 are open at the upper surface of the upper disc 10. Game pieces 18, such as colored balls, are receivable in the tubes from the upper ends thereof, for convenient storage. A side opening 36 in each tube adjacent the upper surface of the bottom disc exposes the bottommost ball for removal for playing. The sleeves 24 surrounding the openings 36 are provided with openings 38 for exposing the openings 36 for removal of a game piece ball 18. By rotating the sleeve to displace the opening 38 from registry with opening 36, the balls 18 are concealed within the tubes, to facilitate transport of the game.

Each disc is provided with a plurality of concentric bands extending outwardly from central post 20. In the embodiment illustrated, there are four such concentric bands 40, 42, 44 and 46 defined between radially spaced concentric circles. Alternatively, the bands may be defined by differently colored concentric circular areas.

Each disc also is provided with a plurality of means which identify position stations for placing game pieces in the process of playing the game. In the illustrated embodiment, since the game pieces 18 are balls, the stations are detents 48 formed in the discs, and each is configured to seat one of the game balls. Alternatively, if the game pieces are cubes or flat chips, the stations may simply be colored patches. In any case, the stations 48 are arranged on each disc on radial lines disposed at 90° intervals around the disc, with one station located in each concentric band on each radial line. The four quadrants of each disc are defined either by the radially extending detents 48, or by radial lines 50 located midway between the lines of detents.

The concentric bands and the radial lines on which the game piece stations are located on the four discs are aligned vertically to facilitate the identification of sequence positions which form a winning pattern.

The method of playing the game is as follows: Each of up to four players is provided with a plurality of game piece balls 18 of a color different from the ball colors for the other players. The balls may be stored in one of the support tubes 22 for convenient access. A selected player starts the game by placing a game piece ball on any one of the station detents 48 on any one of the four discs 10, 12, 14 or 16. The next player in clockwise rotation around the game structure follows by placing a game piece ball of different color on any unoccupied station detent 48. This procedure is repeated by each player in clockwise rotation.

Figure 3:
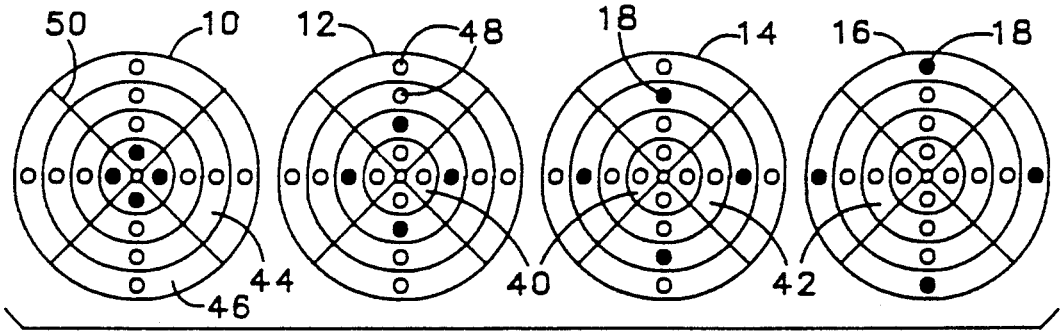
FIGS. 3–9 are plan views of the four playing surfaces of the game of FIG. 1 arranged side-by-side for clarity and showing a variety of arrangements of playing pieces involving one or all playing surfaces and forming winning sequences.
Figure 4:
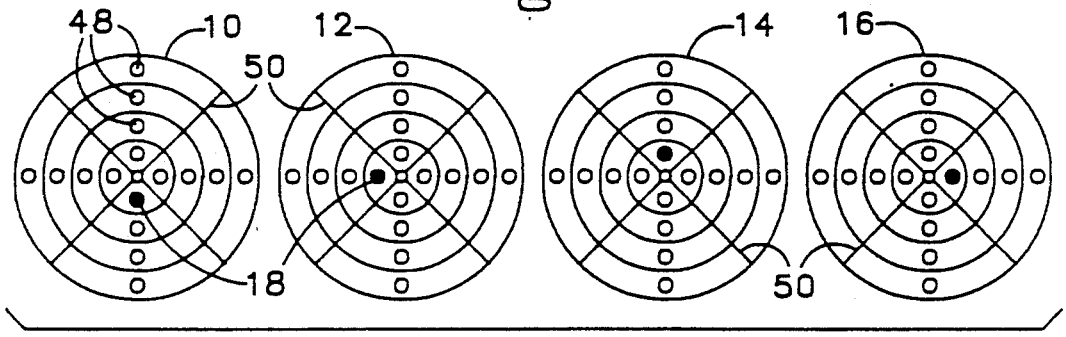

The objective for winning the game is for a player to place four game piece balls in detents which form any one of a variety of sequence patterns. For example, FIG. 3 shows four winning circular patterns in which game piece balls are disposed in the four station detents 48 in any one of the concentric bands 40, 42, 44 or 46. The circular patterns may be completed as helical patterns by placing one game piece ball on a different concentric band on each of the four discs, as in FIG. 4. There are sixteen different patterns available for each.

Figure 5:
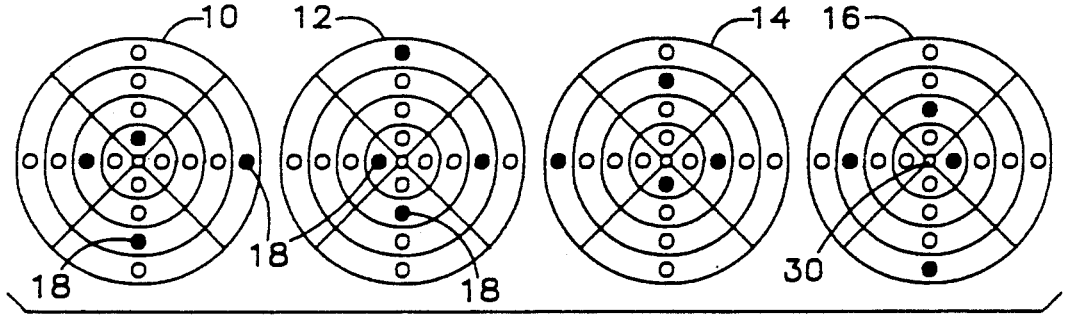
Figure 6:
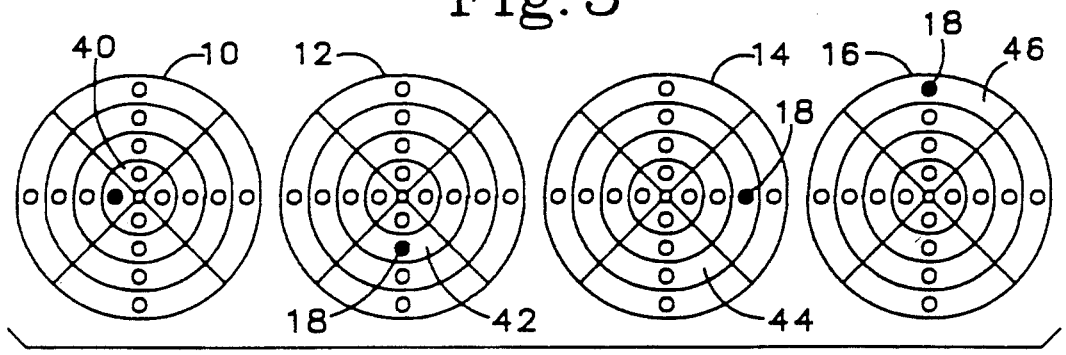

In FIG. 5, the game piece balls 18 are placed in station detents 48 on any one of the discs 10, 12, 14 or 16 to form a clockwise spiral. The spiral may be formed as a helix by placing one game piece ball on a different concentric band on each of the four discs, as shown in FIG. 6. There are sixteen different clockwise and counterclockwise patterns available for each.

Figure 7:
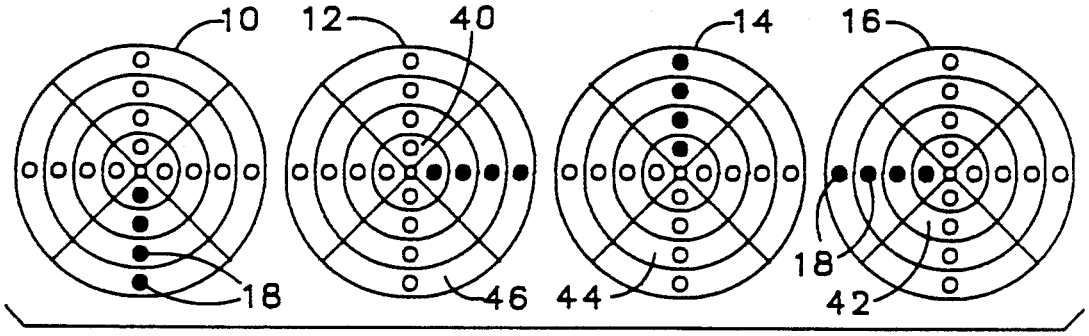
Figure 8:
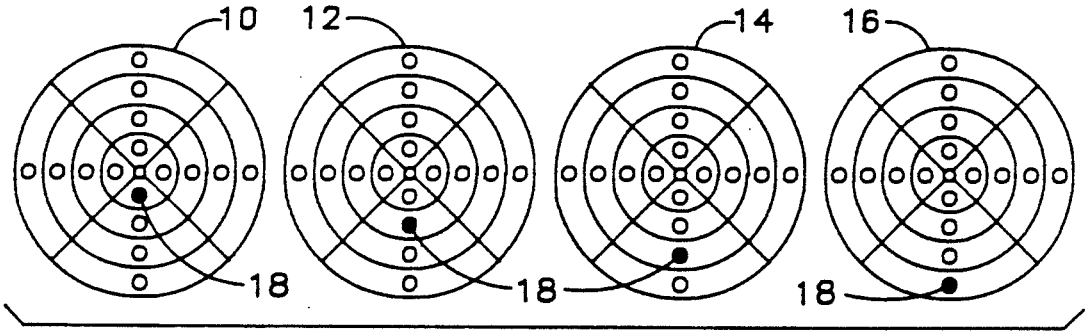

FIG. 7 shows a sequence of game piece balls 18 placed in station detents 48 which are arranged on a radial line on any one of the discs. The sequence may be formed as a diagonal by placing a game piece ball on one station detent on a different concentric band on the corresponding radial line on each of the four discs, as shown in FIG. 8. There are sixteen different patterns available for FIG. 7 and eight "diagonals" available for FIG. 8.

Figure 9:
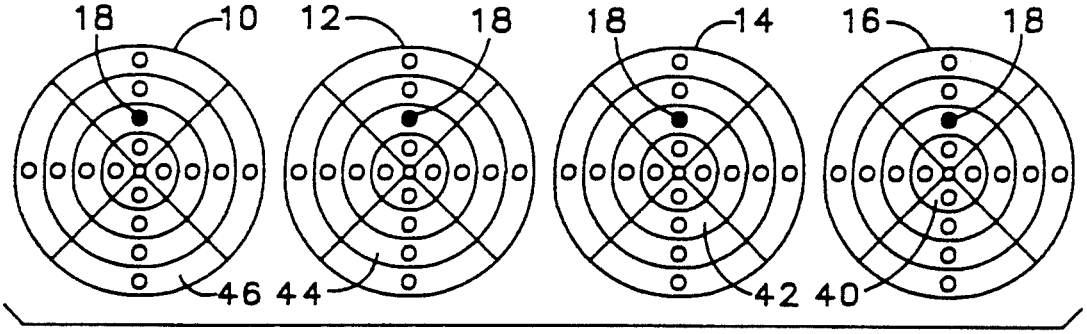

FIG. 9 shows a vertical sequence formed by placing a game piece ball 18 on a station detent 48 located in the same concentric band and radial line of each of the four discs 10, 12, 14 and 16. There are sixteen different patterns available.

It will be apparent that the foregoing and other sequences may be developed by utilizing station detents 48 other than those exemplified in the drawings. The winner of a game is the player who produces a winning sequence, or the player who discovers a sequence unknowingly produced by another player.

It also will be apparent that various modifications and changes may be made in the structural details described hereinbefore. For example, the playing surface plates may be transparent or opaque members made of metal, plastic or wood. They may be formed by the bending of wire to form the quadrants and station detents. Although the illustrated arrangement of four playing levels, four concentric bands and four quadrants is preferred, the game may be constructed of fewer or more playing levels, bands and segments. Further, although the circular form of plate members is preferred, they may be square or they may be polygons of greater than four sides. The plurality of playing surface plates may be supported solely by a central post 20, although the inclusion of the peripheral posts is preferred. The game may be proportioned for playing on a table, or it may be proportioned to serve as a table. For example, it may be proportioned in the size of a coffee table, with the game piece balls 18 the size of tennis balls and the support tubes 22 configured to store the balls. The foregoing and other changes may be made, as desired, without departing from the spirit of this invention and the scope of the appended claims.

I claim:

1. A three-dimensional strategy game, comprising:

a) a plurality of plate members providing playing surfaces, b) means forming a plurality of concentric bands on each plate member, c) a plurality of game piece position stations on each plate member in said concentric bands arranged on radial lines spaced apart about the periphery of the plate member, the number of concentric bands and radial lines being the same as the number of plate members, d) support means securing the late members together in vertically spaced apart relationship with the concentric bands and radial lines of game piece position stations arranged in vertical alignment, and e) a plurality of game pieces configured for mounting on the position stations.

2. The three-dimensional strategy game of claim 1 wherein each plate member is a circular disc and the concentric bands are arranged concentrically about the center of the disc.

3. The three-dimensional strategy game of claim 1 wherein the game includes four plate members each having four concentric bands and four position stations arranged on each of four radial lines disposed 90° from each other.

4. A three-dimensional strategy game, comprising:

a) four plate members providing playing surfaces, b) four concentric bands on each plate member, c) a plurality of game piece position station detents on four each plate member in said concentric bands arranged on radial lines disposed 90° from each other, d) a plurality of vertical posts spaced apart peripherally about the plate members and securing said plate members in vertically spaced apart relationship, the vertical posts being hollow tubes configured to receive game balls therein for storage, each tube having a side opening adjacent the bottom thereof for withdrawing the bottommost game ball, and e) a plurality of game piece balls configured for mounting on the detents.

5. A three-dimensional strategy game, comprising:

a) a plurality of plate members providing playing surfaces, b) means forming a plurality of concentric bands on each plate member, c) a plurality of game position stations on each plate member in said concentric bands arranged on radial lines spaced apart about the periphery of the plate member, the number of concentric bands and radial lines being the same as the number of plate members, d) a plurality of hollow vertical support tubes spaces apart about the periphery of the plate members, and means securing said plate members to said tubes in vertically spaced apart relationship with the concentric bands and radial lines of game piece position stations arranged in vertical alignment, the hollow tubes being configured to receive game balls therein for storage, each tube having a side opening adjacent the bottom thereof for withdrawing the bottommost game ball, and e) a plurality of game pieces configured for mounting on the position stations.

6. The three-dimensional strategy game of claim 5 wherein the securing means comprises spacer sleeves on the tubes between the plate members, the spacer sleeves covering the side opening in the tubes having openings removably registering with the side openings in the tubes.

* * * * *

UNITED STATES PATENT AND TRADEMARK OFFICE

CERTIFICATE OF CORRECTION

PATENT NO. : 5,316,307

DATED : May 31, 1994

INVENTOR(S) : Karol W. Kersh

It is certified that error appears in the above-identified patent and that said Letters Patent is hereby corrected as shown below:

Column 4, line 26, "four" should be deleted.

Column 4, line 65, "opening" should read --openings--.

Signed and Sealed this

Fifth Day of December, 1995

*Attest:*

*Attesting Officer*

Bruce Lehman

BRUCE LEHMAN

*Commissioner of Patents and Trademarks*